US006755739B2

(12) United States Patent
Santini, Jr.

(10) Patent No.: US 6,755,739 B2
(45) **Date of Patent: *Jun. 29, 2004**

(54) METHOD AND APPARATUS FOR IDENTIFYING A WINNER IN A BINGO GAME

(75) Inventor: John A. Santini, Jr., Wakefield, RI (US)

(73) Assignee: Bingo Innovation Software, Lincoln, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/457,196

(22) Filed: Jun. 9, 2003

(65) Prior Publication Data

US 2003/0199304 A1 Oct. 23, 2003

Related U.S. Application Data

(63) Continuation of application No. 10/273,647, filed on Oct. 18, 2002, now Pat. No. 6,607,440, which is a continuation of application No. 09/901,270, filed on Jul. 9, 2001, now Pat. No. 6,482,088, which is a continuation of application No. 09/219,963, filed on Dec. 24, 1998, now Pat. No. 6,257,980.

(51) Int. Cl.[7] ..... A63F 9/22

(52) U.S. Cl. ..... 463/19; 463/16; 463/17; 463/18; 463/25; 463/29; 463/30; 463/40; 463/42; 273/269; 273/236; 273/237; 273/439; 364/410

(58) Field of Search ..... 463/16–19, 25, 463/29, 30, 42; 273/269, 236, 237, 439; 364/410

(56) References Cited

U.S. PATENT DOCUMENTS 3,665,618 A * 5/1972 Hahn ..... 273/270
4,373,726 A * 2/1983 Churchill et al. ..... 463/19

(List continued on next page.)

FOREIGN PATENT DOCUMENTS

GB 2 256 594 A 12/1992
GB 2256594 A * 12/1992 ..... A63F/3/06
JP 5-317485 A 5/1993

OTHER PUBLICATIONS www.vegasbook.net.
Google internet search for bingo 1991 television—1 result—Topeka, Kan., Jan. 21—TV Bingo Network, Inc., 1 page.
Chapter 5, "Data Structures", pp. 122–137.

*Primary Examiner*—Teresa Walberg
*Assistant Examiner*—Yveste G Cherubin
(74) *Attorney, Agent, or Firm*—Banner & Witcoff, Ltd.

(57) ABSTRACT

A method and apparatus are disclosed for identifying a winner in a bingo game. Players may obtain bingo cards from point-of-sale (POS) terminals that physically prints bingo cards for players in an embodiment where the player appears in person to purchase tickets, or from point-of-sale (POS) terminals that permit players to play bingo in an on-line environment. A game processor maintains a linked list identifying each card in play containing each possible value. Each entry in a linked list includes a pointer to the next element in the linked list. Each bingo card is represented as a bitmap containing an entry corresponding to each square on the bingo card. Each entry in the linked list also identifies the particular square on the bingo card containing the corresponding value, thereby allowing the appropriate entry in the corresponding bitmap to be identified. As each number is drawn, the game processor utilizes the linked list to identify all of the bingo cards in play having the drawn number. As each card containing the drawn number is identified, the corresponding entry in the bitmap is marked. Each possible winning pattern in a bingo game is likewise represented as a bitmap. If a bit in the winning bitmap is set to a value of 1, then the corresponding square must be set on a player's bingo card in order to match the pattern. Winning players are identified by comparing the card bitmap to each of the possible winning bitmaps. If all the 1's that are set in any bitmap for a winning pattern are also set in the card bitmap, then the card is a winning card.

11 Claims, 12 Drawing Sheets

U.S. PATENT DOCUMENTS 4,436,308 A * 3/1984 Rose et al. ..... 463/31
4,467,424 A * 8/1984 Hedges et al. ..... 463/26
4,475,157 A * 10/1984 Bolan ..... 463/19
4,624,462 A * 11/1986 Itkis ..... 273/237
4,661,906 A * 4/1987 DiFrancesco et al. ..... 463/19
4,747,600 A * 5/1988 Richardson ..... 463/19
4,756,531 A * 7/1988 DiRe et al. ..... 463/18
4,830,405 A * 5/1989 Di Bella ..... 283/70
4,856,787 A * 8/1989 Itkis ..... 273/237
4,909,516 A * 3/1990 Kolinsky ..... 463/19
5,054,787 A * 10/1991 Richardson ..... 463/19
5,096,202 A * 3/1992 Hesland ..... 273/237
5,283,734 A * 2/1994 Von Kohorn ..... 463/17
5,324,035 A * 6/1994 Morris et al. ..... 463/42
5,351,970 A * 10/1994 Fioretti ..... 463/19
5,518,253 A * 5/1996 Pocock et al. ..... 463/19
5,624,119 A * 4/1997 Leake ..... 273/269
5,951,396 A * 9/1999 Tawil ..... 463/19
6,257,980 B1 * 7/2001 Santini, Jr. ..... 463/19
6,607,440 B2 * 8/2003 Santini, Jr. ..... 463/19

* cited by examiner

LOGICAL INDICES ASSIGNMENT 200

| B | I | N | G | O |
|---|---|---|---|---|
| 0 | 5 | 10 | 15 | 20 |
| 1 | 6 | 11 | 16 | 21 |
| 2 | 7 | 12 | 17 | 22 |
| 3 | 8 | 13 | 18 | 23 |
| 4 | 9 | 14 | 19 | 24 |

Fig. 2

CARD DECK LAYOUT

300

| BYTE 0 | BYTE 1 | BYTE 2 | BYTE 3 | BYTE 4 | BYTE 5 | BYTE 6 | BYTE 7 | BYTE 8 | BYTE 9 | BYTE 10 | BYTE 11 | BYTE 12 |
|---|---|---|---|---|---|---|---|---|---|---|---|---|
| B1 | B0 | B3 | B2 | I0 | B4 | I2 | I1 | I1 | I3 | N1 | N0 | N3 | N2 | G0 | N4 | G2 | G1 | G4 | G3 | O1 | O0 | O3 | O2 | ... | O4 |

Fig. 3

BASE MAP 400

| | VALUE 1 | VALUE 2 | VALUE 3 | | VALUE 75 |
|---|---|---|---|---|---|
| MAP BASE | pNEXT-1 | pNEXT-2 | pNEXT-3 | . . . | pNEXT-75 |

Fig. 4A

CARD MAPS 450

| | SQUARE 0 | SQUARE 1 | | SQUARE 24 |
|---|---|---|---|---|
| CARD N | pNEXT-CARD | pNEXT-CARD | . . . | pNEXT-CARD |
| CARD 2 | pNEXT-CARD | pNEXT-CARD | . . . | pNEXT-CARD |
| CARD 1 | pNEXT-CARD | pNEXT-CARD | . . . | pNEXT-CARD |
| CARD 0 | pNEXT-CARD | pNEXT-CARD | . . . | pNEXT-CARD |

Fig. 4B

PATTERN MATCHING ARRAY 500

| B | I | N | G | O |
|---|---|---|---|---|
| X | | | | X |
| | X | | X | |
| | | X | | |
| | X | | X | |
| X | | | | X |

Fig. 5A

550

PATTERN MATCHING BITMAP

| BIT | 24 | 23 | 22 | 21 | 20 | 19 | 18 | 17 | 16 | 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|---|---|---|---|---|---|---|---|---|---|
| VALUE | 1 | 0 | 0 | 0 | 1 | 0 | 1 | 0 | 1 | 0 | 0 | 0 | 1 | 0 | 0 | 0 | 1 | 0 | 1 | 0 | 1 | 0 | 0 | 0 | 1 |

Fig. 5B

METHOD AND APPARATUS FOR IDENTIFYING A WINNER IN A BINGO GAME

This application is a continuation of application Ser. No. 10/273,647, filed Oct. 18, 2002, now U.S. Pat. No. 6,607,440 which is a continuation of application Ser. No. 09/901,270, filed Jul. 9, 2001, now U.S. Pat. No. 6,482,088, issued Nov. 19, 2002, which is a continuation of application Ser. No. 09/219,963, filed Dec. 24, 1998, now U.S. Pat. No. 6,257,980, issued Jul. 10, 2001, the entire disclosures of which are hereby incorporated by reference.

FIELD OF THE INVENTION

The present invention relates to a bingo game, and more particularly, to a method and apparatus for identifying a winner in a bingo game.

BACKGROUND OF THE INVENTION

Bingo is a popular and well-known game. In a conventional bingo game, players are provided with bingo cards that have a matrix of five rows and five columns. Normally, the numbers 1 through 75 are divided into five sets, with each set having fifteen numbers. Each set is associated with a vertical column in the matrix and each column from left to right is assigned one letter from the word "bingo." Frequently, the center space in the matrix is a "free space." Bingo balls are individually numbered from 1 through 75 and are mixed together. Balls are then randomly selected one at a time. As each selected number is announced, each player covers any corresponding number on his or her bingo card. Play continues until a player achieves a predefined winning arrangement or pattern of spots on the bingo card.

Traditionally, there are twelve winning arrangements or pattern of spots. Specifically, in a traditional bingo game, a player wins if the player covers any of the five vertical columns, any of the five horizontal rows or either of the two diagonals on the bingo card. Other winning combinations include the four comers of the bingo card, the eight spots immediately surrounding the free space, or a diamond pattern. The "bingo boss" who operates the bingo game will announce the winning arrangement or pattern of spots at the beginning of each game.

Bingo is a popular form of entertainment. Bingo games can be played for free, purely for amusement, or for a fee, as a form of gambling. Many government and private entities conduct bingo games for a fee. Government-conducted bingo games generally involve a larger pool of players and offer players the chance to win a larger prize, while also providing revenues to the government entity. When players must pay to participate in a bingo game, players purchase bingo cards for use during a particular bingo session and winning players receive a payout from the operator or gaming establishment. For each bingo game, the first player to obtain a winning pattern wins the game.

Typically, government-conducted lottery systems utilize a central lottery computer to communicate with remote point-of-sale lottery terminals. The Rhode Island Lottery Commission (the "RILC") proposed a state-wide bingo game, referred to as "Power Bingo" in 1997, where players purchased bingo cards from the remote point-of-sale lottery terminals and the game was to be broadcast on television. Although the Power Bingo game was suspended before ever being played, bingo cards were sold by the RILC for an initial game. The point-of-sale lottery terminals requested bingo cards from the central lottery computer. After the central lottery computer generated the bingo card information, the point-of-sale lottery terminal, under the direction of the central lottery computer, printed the official bingo cards. The central lottery computer maintained a database containing the bingo card information for each bingo card that was issued.

Since the players were remote from the venue where the numbers were drawn, the RILC needed to determine whether any players had won before drawing a new ball. In addition, after each ball was drawn, the RILC proposed to broadcast statistics indicating in real-time the number of players that were three balls, two balls, one ball and zero balls (a winner) away from a winning pattern. Thus, after each ball was drawn, the RILC was required to perform a brute force search of all issued bingo cards to compare the current status of each player's bingo cards to templates corresponding to winning patterns. Such brute force searching is very time consuming, and possibly unmanageable, when the number of issued bingo cards is large. For a bingo game to run smoothly, and to maintain the players' interest, it is estimated that a ball should be drawn approximately every five seconds.

Similarly, a number of private entities, such as Gamesville.com, allow a potentially large pool of players to play bingo over the Internet for prizes. In such an on-line implementation, players typically access a web site and request one or more bingo cards. A central server maintains a database containing the bingo card information for each bingo card that is issued. Again, since the players are remote from the venue where the numbers were drawn, a mechanism is needed to determine whether a player has won before drawing the next ball. At least one such on-line bingo game requires players to mark their own bingo cards as numbers are drawn and to submit a request to confirm that the player has won, when the player believes they have a winning pattern.

As apparent from the above-described deficiencies with conventional bingo games, a need exists for an improved method for promptly identifying a winner in a bingo game. A further need exists for an improved method for determining the number of balls that each player is away from a winning pattern.

SUMMARY OF THE INVENTION

Generally, a method and apparatus are disclosed for identifying a winner in a bingo game. The bingo system includes a network for transferring information between a central game processor and one or more remote point-of-sale (POS) terminals. Players may obtain bingo cards from point-of-sale (POS) terminals that physically print bingo cards for players in an embodiment where the player appears in person to purchase tickets, or from point-of-sale (POS) terminals that permit players to play bingo in an on-line environment.

According to one aspect of the invention, the game processor maintains a linked list identifying each card in play containing each possible value. For example, in a conventional bingo game having 75 possible values, the game processor maintains 75 different linked lists. Each entry in a linked list includes a pointer to the next element in the linked list. In addition, the game processor represents each bingo card as a bitmap containing an entry corresponding to each square on the bingo card. Each entry in the linked list also identifies the particular square on the bingo card containing the corresponding value, thereby allowing the appropriate entry in the corresponding bitmap to be identified.

As each number is drawn, the game processor utilizes the linked list to identify all of the bingo cards in play having the drawn number. As each card containing the drawn number in the linked list is identified, the game processor marks the corresponding entry in the bitmap. According to another aspect of the invention, each possible winning pattern in a bingo game is likewise represented as a bitmap. If a bit in the winning bitmap is set to a value of 1, then the corresponding square must be set on a player's bingo card in order to match the pattern.

The present invention allows winning players to be identified by comparing the card bitmap to each of the possible winning bitmaps. Generally, the comparison determines whether all the 1's that are set in any bitmap for a winning pattern are also set in the card bitmap. If so, the card is a winning card. In one preferred implementation, only those cards containing the number just drawn are compared to the possible winning bitmaps.

A more complete understanding of the present invention, as well as further features and advantages of the present invention, will be obtained by reference to the following detailed description and drawings.

BRIEF DESCRIPTION OF THE DRAWINGS

FIG. 2 illustrates the logical indices that are assigned to each square of a bingo card to facilitate storage of the bingo cards in play by the game processor of FIG. 1;

FIG. 3 illustrates a representative layout of the bits corresponding to each square in memory;

FIGS. 4A and FIG. 4B illustrates a linked list of maps that identify each card in play containing each possible value in accordance with the present invention;

FIG. 5A illustrates the well known "X" winning pattern;

FIG. 5B illustrates a bitmap representation of the "X" pattern of FIG. 5B in accordance with the present invention;

DETAILED DESCRIPTION

Figure 1:
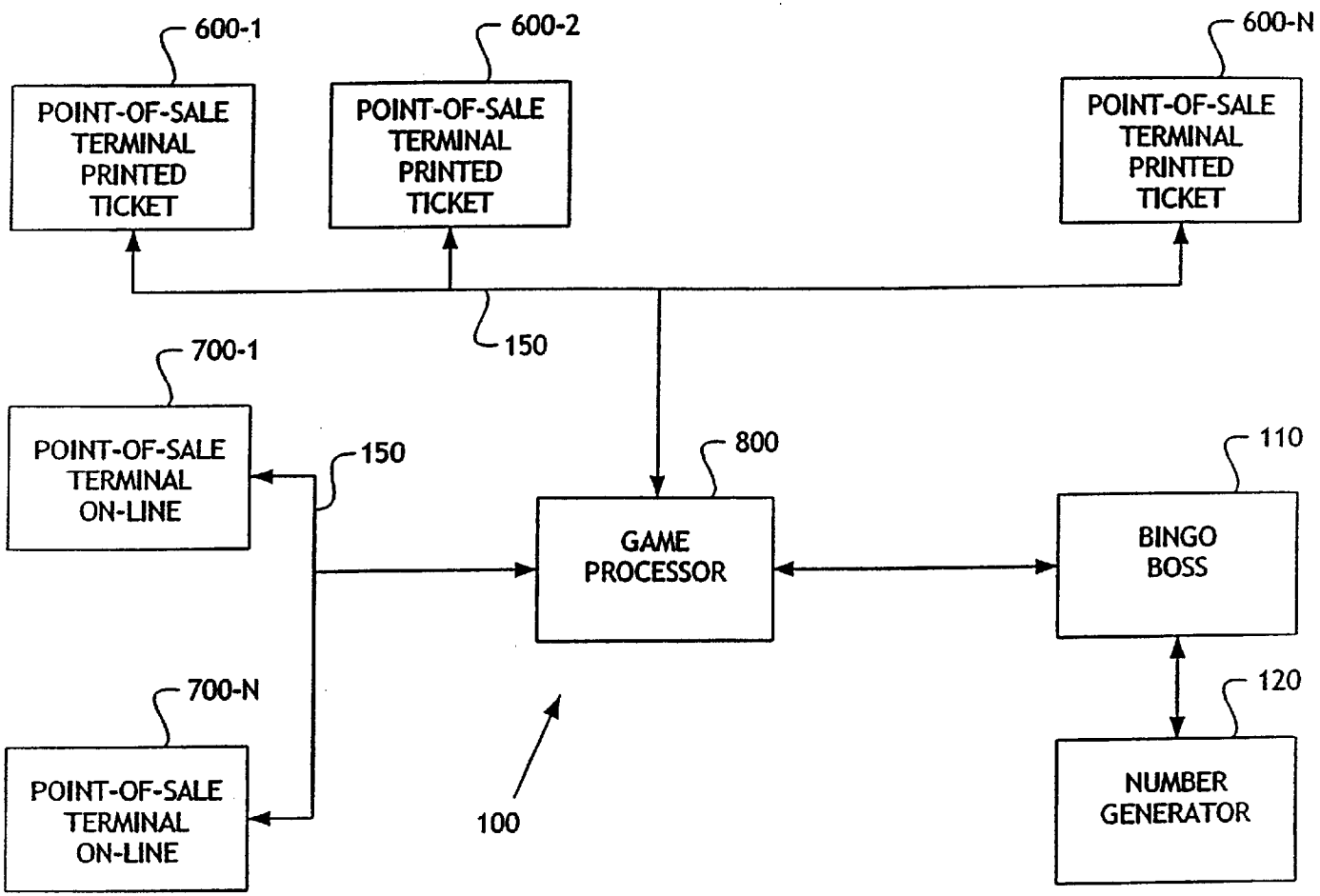
FIG. 1 illustrates a bingo system for processing bingo transactions in accordance with the present invention.

FIG. 1 shows a bingo system 100 for processing bingo transactions, including the issuance and validation of bingo cards, for example, by a government or private entity. The bingo system 100 includes a network 150 for transferring information between a central game processor 800, discussed below in conjunction with FIG. 8, and one or more remote point-of-sale (POS) terminals 600-N and 700-N. An illustrative point-of-sale (POS) terminal 600 that physically prints bingo cards for players is discussed below in conjunction with FIG. 6. An illustrative point-of-sale (POS) terminal 700 that permits players to play bingo in an on-line environment is discussed below in conjunction with FIG. 7.

As shown in FIG. 1, the bingo system 100 optionally includes a bingo boss 110 that operates and controls the play of a bingo game. The bingo boss 110 may be a human being or a programmed processor. Generally, the bingo boss 110 is responsible for drawing bingo balls and validating a winner. In addition, the bingo system 100 includes a number source 120, such as a set of 75 numbered balls that are randomly drawn, or a random number generator that generates numbers in the range of 1 through 75.

According to one feature of the present invention, the game processor 800 maintains a linked list of each card in play containing each possible value. Thus, in a conventional bingo game, where there are 75 possible values, the game processor 800 maintains 75 different linked lists. As discussed below, each entry in a linked list includes a pointer to the next element in the linked list, in a well-known manner.

According to another feature of the present invention, the game processor 800 represents each bingo card as a bitmap containing an entry corresponding to each square on the bingo card. In addition to a pointer to the next element in the linked list, each entry in the linked list identifies the square on the bingo card containing the corresponding value, thereby allowing the appropriate entry in the corresponding bitmap to be identified. Thus, as each number is drawn, the game processor 800 utilizes the linked list to identify all of the bingo cards in play having the drawn number. As each card containing the drawn number in the linked list is identified, the game processor 800 marks the corresponding entry in the bitmap.

In addition, each possible winning pattern in a bingo game is likewise represented as a bitmap. As discussed below in conjunction with FIGS. 5A and 5B, each square on the bingo card is allocated one bit in the bitmap corresponding to a particular winning pattern. If a bit in the winning bitmap is set to a value of 1, then the corresponding square must be set on a player's bingo card in order to match the pattern.

Thus, in accordance with the present invention, winning players may be identified by comparing the card bitmap to each of the possible winning bitmaps. Generally, the comparison determines whether all the 1's that are set in any bitmap for a winning pattern are also set in the card bitmap. If so, the card is a winning card. In one preferred implementation, only those cards containing the number just drawn are compared to the possible winning bitmaps.

FIG. 2 illustrates the logical indices that are assigned to each square of a bingo card to facilitate storage of the bingo cards in play by the game processor 800. As shown in FIG. 2, the bingo card 200 is logically divided into 25 squares that are numbered 0 through 24. The values within each square on a given card are stored in memory by the game processor 800. In an illustrative embodiment, two values are stored for each byte. Thus, four bits are allocated to each square of the bingo card, allowing the values 0 through 15 to be represented.

FIG. 3 illustrates a representative layout 300 of the bits corresponding to each square in memory. Thus, byte 5 in FIG. 3 contains four bits for encoding the value in the first square of the N column, and four bits for encoding the value in the second square of the N column. Since each row contains 15 possible values, the column index (zero based) is multiplied by 15 and added to the four bit value plus one, to yield the value of each square on the card. For example, if a card includes a value of N32, the value will be encoded as 0010, the binary value corresponding to the integer 2 (32-30). After the bingo cards have been encoded into the format shown in FIG. 3, the resulting data is referred to as a "card deck" 300. As discussed further below, the card deck 300 is stored on disk by the game processor 800 and loaded into memory at run time. Generally, during the processing of the game, the card deck 300 is not used.

FIG. 4A illustrates a base map 400 and FIG. 4B illustrates a plurality of card maps 450. During program initialization, a map development process 900, discussed below in conjunction with FIG. 9, converts the card deck 300 the map formats shown in FIGS. 4A and 4B. The map base 400 contains a slot for each value that may appear on a bingo card. Thus, for a conventional bingo game, having 75 possible values, the map base 400 contains 75 slots. Each slot, corresponding to a value, n, contains a pointer, pNEXT-n, to the first card map 450 corresponding to a card containing the associated value, n. For example, the slot corresponding to value N32, contains a pointer to the first card in the set of card maps 450 that has a square with N32.

In addition, as shown in FIG. 4B, each card map 450 contains a slot for each square on a bingo card. Thus, for a conventional bingo game, having 25 squares, the card map 450 contains 25 slots. Each slot, corresponding to a square, i, contains a pointer, pNEXT-CARD, to the next card map 450 corresponding to a card containing the desired value, n. Thus, each slot of the map base 400 contains a pointer to the first card containing the corresponding value. The pointer indexes a linked list in the card maps 450 of each of the additional cards containing the same value.

In one illustrative implementation, the pointer, pNEXT-n, is a 4 byte value containing two parts, with 3 bits indicating a row offset and 29 bits providing a card offset to the first card containing the associated value. The 3-bit row offset allows rows 0 through 4 to be uniquely identified. Likewise, the pointer, pNEXT-CARD, is a 2 byte value containing two parts, with 3 bits again indicating a row offset and 13 bits providing a card offset to the next card in the linked list containing the associated value.

Thus, the exact location of the next occurrence of any value can be determined by using the card offset to locate the desired card, and the row offset to identify the appropriate row. The column is obtained implicitly by dividing the value itself minus one by the number of possible value in the column, such as 15 in the illustrative embodiment, with the whole number indicating the column number (zero based). Thus, each pointer points to a cell containing a like value that leads to the next occurrence of a particular value, until a value of zero is encountered, indicating the end of the linked list.

A bingo winner is defined as a player having a bingo card with a matching a predefined winning arrangement or pattern of spots on the bingo card. FIG. 5A illustrates the well known "X" winning pattern. According to a further feature of the invention, each winning pattern is implemented as a bitmap, such as the bitmap 550, shown in FIG. 5B, for the "X" pattern. It is noted that some bingo games offer multiple winning patterns. As previously indicated, a traditional bingo game has twelve predefined winning patterns: any of the five vertical columns, any of the five horizontal rows or either of the two diagonals on the bingo card. Other winning combinations include the four corners of the bingo card, the eight spots immediately surrounding the free space, or a diamond pattern.

As shown in FIG. 5B, each square on the bingo card is allocated one bit in the bitmap 550 corresponding to a particular winning pattern. If a bit in the bitmap 550 is set to a value of 1, then the corresponding square must be set on a player's bingo card in order to match the pattern. A standard bingo card, having 25 squares, requires only 25 bits. Thus, each bitmap 550 may be implemented as a 32-bit integer value, although the present invention permits larger patterns to be implemented using a list of 320-bit integers. As shown in FIG. 5B, squares on the bingo card are ordered in the same manner as the logical indices that are assigned to each square of a bingo card for storage in a card deck 300. The least significant bit in the bitmap 550 corresponds to the top-left corner of the bingo card, and the most significant bit in the bitmap 550 corresponds to the bottom-right corner of the bingo card.

As discussed further below in conjunction with FIG. 11, each bingo card in play is represented as a 25-bit card bitmap that initially has a value representing the location of any and all free spaces. As each number is drawn in the bingo game, the drawn value is used as an index into the base map 400 and the card maps 450 to identify all the cards in the card deck 300 having the drawn value. For each identified card, the row and (implicit) column offsets are used to set the bit in the corresponding card bitmap to a value of 1. As the bitmap of each identified card is marked in this manner, the card bitmap is compared with each possible winning bitmap. Generally, the comparison determines whether all the 1's that are set in any bitmap for a winning pattern are also set in the card bitmap. If so, the card is a winning card.

In addition, players are often interested in the number of balls they (or other players) are away from winning. The number of balls that are required to be a winner can be obtained by determining how many 1's are set in each bitmap corresponding to a possible winning pattern, that do not appear in the card bitmap. If any card comparison results in a value of 0, then the card is a winner.

Figure 6:
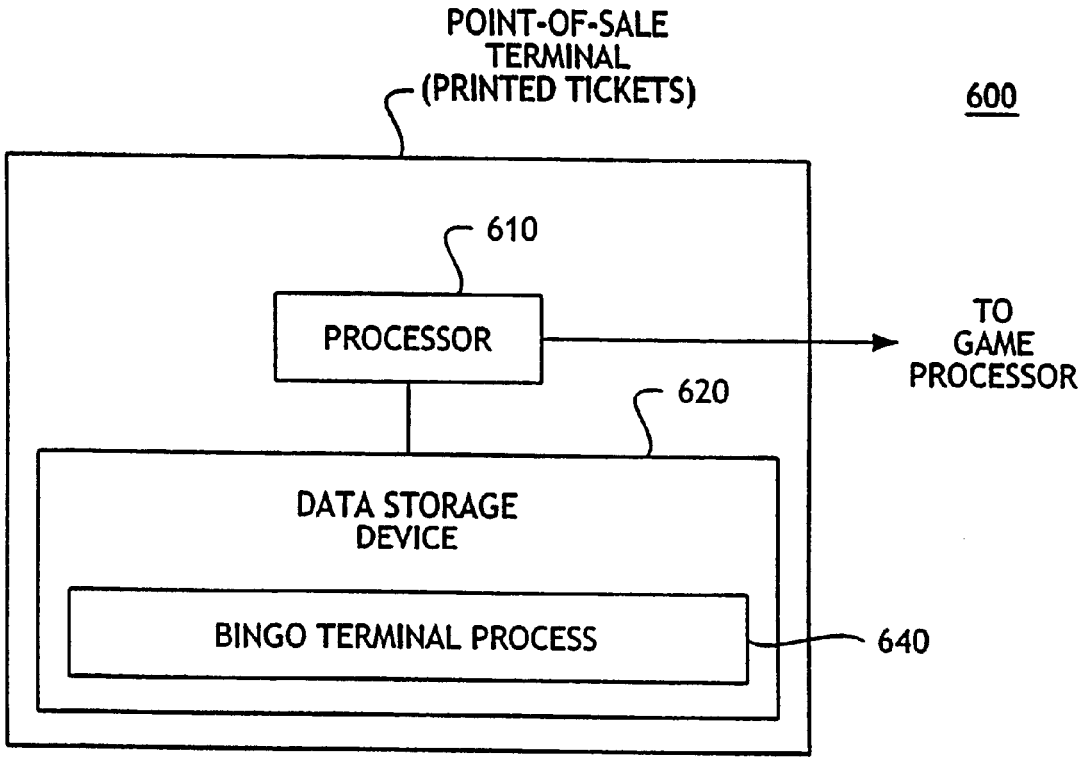
FIG. 6 is a schematic block diagram of an illustrative point-of-sale (POS) terminal of FIG. 1, that physically prints bingo cards for players, in an embodiment where the player appears in person to purchase tickets.

FIG. 6 is a block diagram showing the architecture of an illustrative point-of-sale (POS) terminal 600 that physically prints bingo cards for players, in an embodiment where the player appears in person to purchase tickets. The point-of-sale (POS) terminal 600 may be embodied, for example, as a conventional dedicated lottery terminal, as modified herein to execute the functions and operations of the present invention. The point-of-sale (POS) terminal 600 preferably includes a processor 610 and related memory, such as a data storage device 620. The processor 610 may be embodied as a single processor, or a number of processors operating in parallel. In addition, the point-of-sale (POS) terminal 600 includes one or more ports (not shown) for communicating with the game processor 800, for example, over the network 150.

The data storage device 620 and/or a read only memory (ROM) are operable to store one or more instructions, which the processor 610 is operable to retrieve, interpret and execute. As shown in FIG. 6, the data storage device 620 preferably includes a bingo terminal process 640 that receives a player request for one or more bingo cards and communicates with the game processor 800 via the network 150 to obtain and validate the bingo cards and thereafter issue the requested number of bingo cards to the player.

Figure 7:
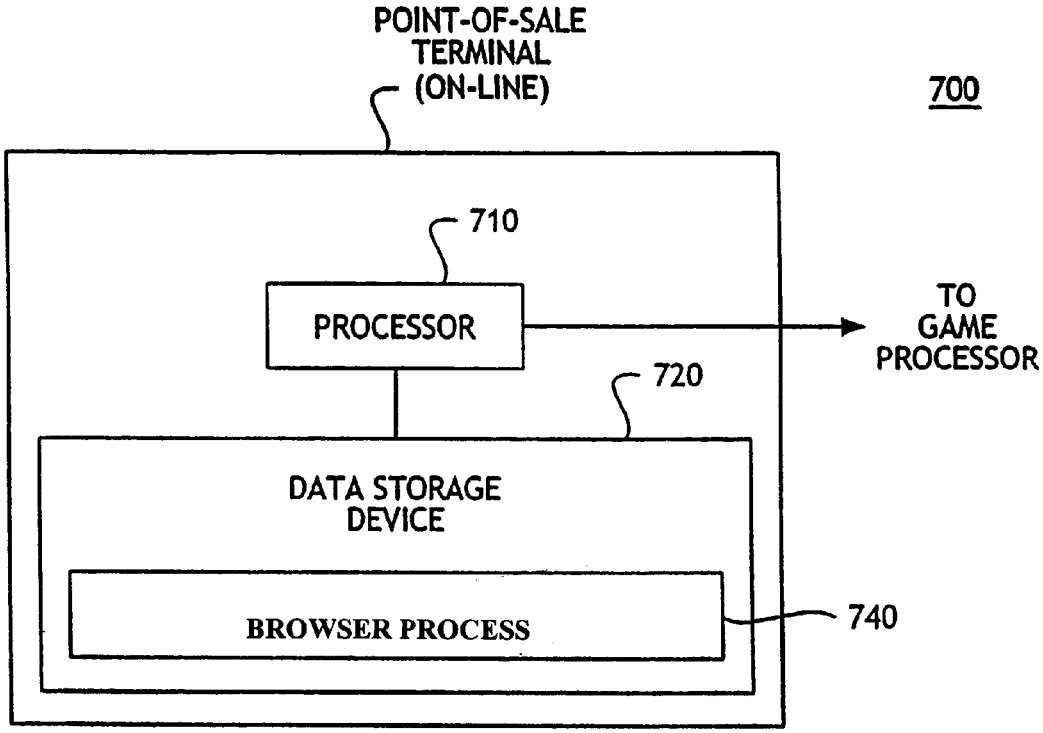
FIG. 7 is a schematic block diagram of an illustrative point-of-sale (POS) terminal of FIG. 1, for an on-line implementation.

FIG. 7 is a block diagram showing the architecture of an illustrative point-of-sale (POS) terminal 700 for an on-line implementation. The point-of-sale (POS) terminal 700 may be embodied, for example, as a personal computer or other device that allows a bingo player to individually establish remote communication with the game processor 800, as modified herein to execute the functions and operations of the present invention. The point-of-sale (POS) terminal 700 preferably includes a processor 710 and related memory, such as a data storage device 720, which operate in a similar manner to the hardware described above in conjunction with FIG. 6.

The data storage device 720 preferably includes a browser process 740 that allows a player to obtain a connection, for example, over the Internet, to a web site where the bingo game discussed herein is played. Alternatively, the data storage device 720 may include dedicated software that allows a player to communicate with the game processor 800 for example, by means of a modem connection over the public switched telephone network (PSTN).

Figure 8:
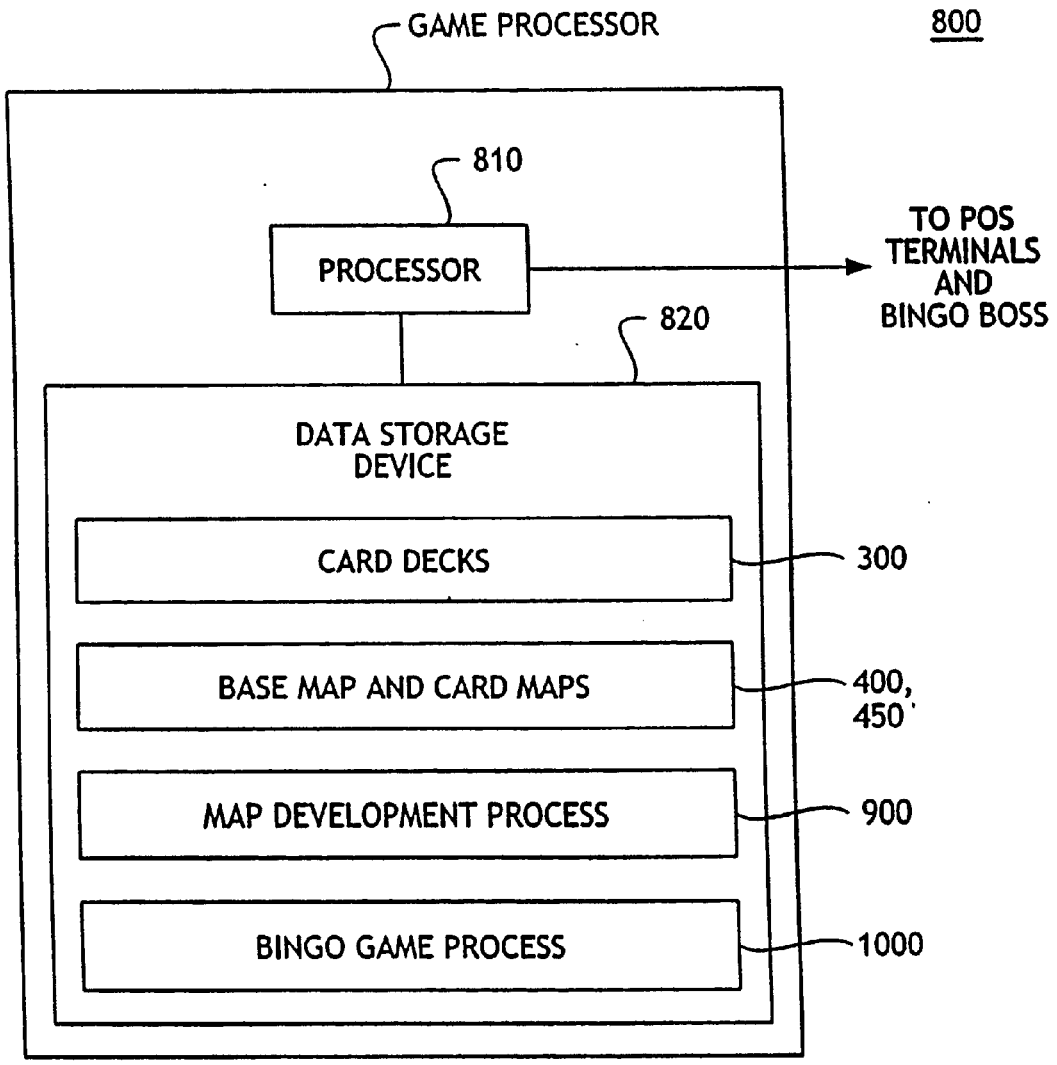
FIG. 8 is a schematic block diagram of the game processor of FIG. 1.

FIG. 8 is a block diagram showing the architecture of an illustrative game processor 800. The game processor 800 may be embodied, for example, as an RS 6000 server, manufactured by IBM Corp., as modified herein to execute the functions and operations of the present invention. The game processor 800 preferably includes a processor 810 and related memory, such as a data storage device 820, which operate in a similar manner to the hardware described above in conjunction with FIG. 6. It is noted that the game processor 800 may be embodied as a single processor, or a number of distributed or local processors operating in parallel. For example, the game processor 800 may include a dedicated processor for communicating with the point-of-sale (POS) terminals 600 that physically prints bingo cards for players and a dedicated processor for communicating with the point-of-sale (POS) terminals 700 in an on-line implementation.

As shown in FIG. 8, the data storage device 820 includes the card decks 300, discussed above in conjunction with FIG. 3, and the base map 400 and corresponding card maps 450, discussed above in conjunction with FIGS. 4A and 4B, respectively. In addition, the data storage device 820 includes a map development process 900, discussed below in conjunction with FIG. 9, that converts the card deck 300 into the base map 400 and corresponding card maps 450. The data storage device 820 also includes a bingo game process 1000, discussed below in conjunction with FIG. 10, that processes each number that is drawn, and identifies a winner in accordance with the present invention.

Figure 9:
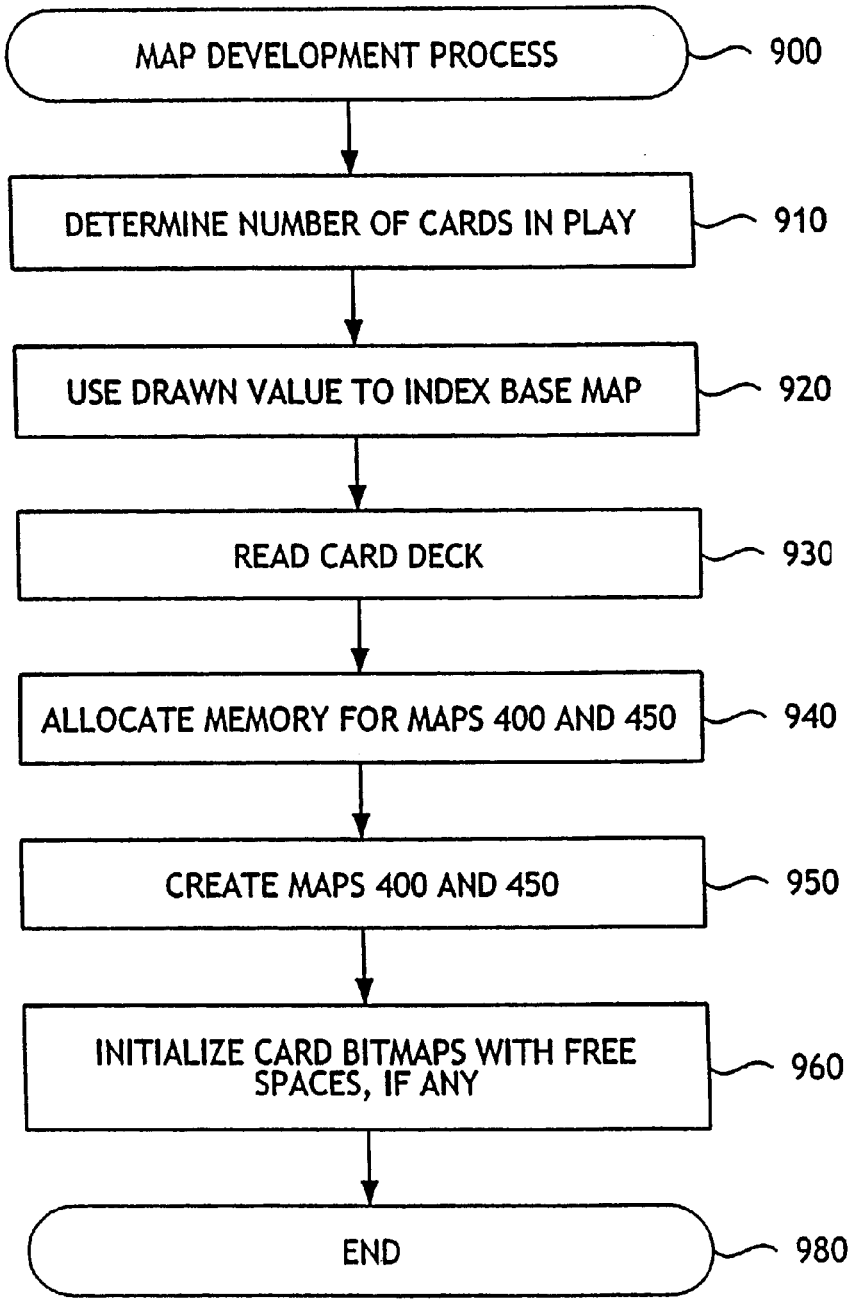
FIG. 9 is a flow chart describing an exemplary map development process of FIG. 8.

FIG. 9 illustrates the map development process 900 that converts the card deck 300 into the base map 400 and corresponding card maps 450, and otherwise initializes the game processor 800. As shown in FIG. 9, the map development process 900 initially determines the number of cards in play for a given bingo game during step 910, and then allocates the appropriate amount of memory during step 920 for the card decks 300. The map development process 900 reads the card deck during step 930, and then allocates the appropriate amount of memory during step 940 for the base map 400 and the card maps 450.

The map development process 900 converts the card deck 300 into the base map 400 and corresponding card maps 450 during step 950. Generally, the maps 400 and 450 are created by reading the value from each square on each card deck 300, and adding an entry in the appropriate chain linked list of the maps 400, 450 corresponding to each value on the card. As previously indicated, each entry added to the chain linked list contains a card offset that points to the next card in the linked list, and a row offset that is used to identify which square on the card contains the corresponding value.

Finally, the card bitmaps are initialized with any free spaces during step 960. In other word, if any space, such as the center square, is defined as a free space in a given bingo game, then the corresponding entry in all the card bitmaps is set to 0. Program control terminates during step 580, and the game processor 800 is ready to initiate play.

Figure 10:
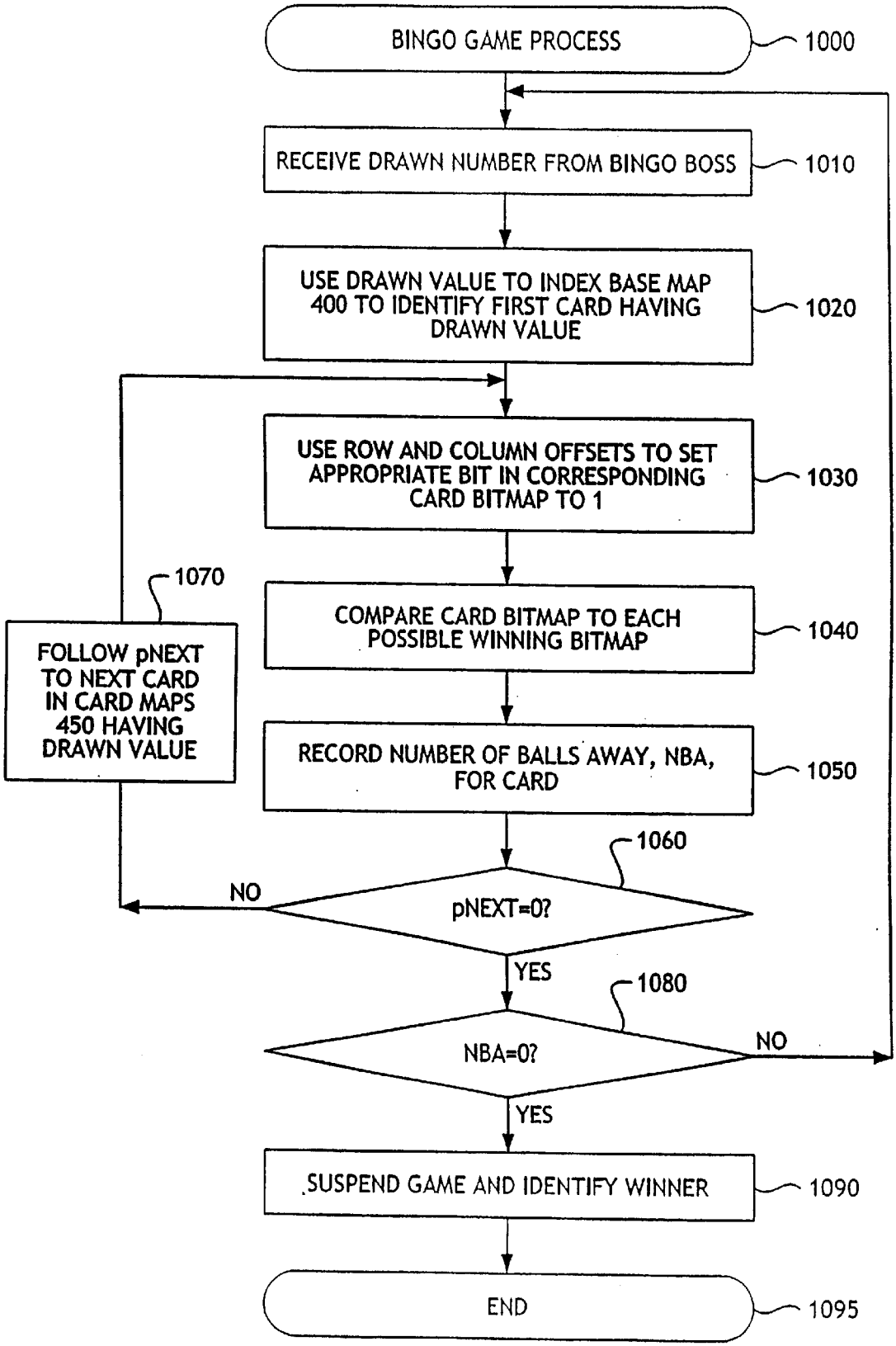
FIG. 10 is a flow chart describing an exemplary bingo game process of FIG. 8.

As previously indicated, the bingo game process 1000, shown in FIG. 10, processes each number that is drawn, and identifies a winner in accordance with the present invention. The bingo game process 1000 initially receives a drawn number from the bingo boss 110 during step 1010. The drawn number is then used during step 1020 to index the base map 400 to identify the first card having the drawn value. As previously indicated, each bingo card in play is represented as a 25 -bit card bitmap, that initially has a value of all zeros. As each number is drawn in the bingo game, the drawn value is used as an index into the base map 400 and the card maps 450 to identify all the cards in the card deck 300 having the drawn value. For each identified card, the row and (implicit) column offsets are used to set the appropriate bit in the corresponding card bitmap to a value of 1. Thus, the row and column offsets into the corresponding card bitmap are obtained from the entry in the base map 400 (or the card maps 450 on subsequent passes through the bingo game process 1000) and are used to set (mark) the appropriate bit during step 1030.

The current card bitmap is then compared to each possible winning bitmap during step 1040. Generally, the comparison determines how many 1's are set in each bitmap corresponding to a possible winning pattern, that do not appear in the card bitmap. In one implementation, the comparison is performed using an exclusive or (XOR) operation. Specifically, the following operation yields a value, t, in which exactly those bits set in the winning pattern, m, which are not set in the card bitmap, v, are set:

$$t=(m\hat{}v)\&m.$$

As discussed below, if t equals zero, then the card matches the winning pattern and is thus a winning card. For example, if a card bitmap equals 0100100010011000101010011, and the bingo game requires an "X" pattern, such as the pattern shown in FIG. 5A, to win the game, the result of the "exclusive or", and the "and" operation performed on the card bitmap relative to the bitmap shown in FIG. 5B for the "X" pattern yields a value, t, of 10000010000000000000000000. Thus, there are two squares (24 and 18) on the corresponding bingo card that are not yet marked that are required to match the winning "X" pattern.

During step 1050, the number of balls away, NBA, from a winning pattern are recorded for the card. In other words, the number of 1's in the value, t, are counted. In one implementation, a count table having 64K entries is used to perform the count during step 1050. The count table may be created, for example, by the map development process 900 during program initialization. Each 16-bit entry in the count table indicates the number of 1's in the corresponding binary value. Thus, the 32 bit value, t, is broken into two 16 bit components which are each used to index the count table. The number of 1's corresponding to each 16-bit value is then summed to yield the number of balls away, NBA, from a winning pattern. For a bingo game having multiple winning patterns, the winning pattern with the lowest the number of balls away, NBA, is selected for the card and recorded during step 1050.

In an alternate implementation, the comparison performed during step 1040 and the determination of the number of balls away, NBA, performed during step 1050 may be performed by AND'ing the card bitmap with each possible winning bitmap, to obtain a result, u, and then using the count table to subtract the count (u) from the count (winning bitmap). In addition, it is noted that the assembly language for a microprocessor may provide a count instruction, to eliminate the need for the count table.

Once the number of balls away, NBA, from a winning pattern is determined during step 1050, a test is performed during step 1060 to determine if the pointer, pNEXT, from the entry in the current map 400, 450 is zero. If it is determined during step 1060 that the pointer, pNEXT, from the entry in the current map 400, 450 is not zero, then there is another card map 450 in the linked list corresponding to another card having the current drawn value. Thus, the pNEXT pointer is followed during step 1070 to the next card in the card maps 450 having the drawn value. Thereafter, program control proceeds to step 1030 and continues processing the next card map 450- in the manner described above.

If, however, it is determined during step 1060 that the pointer, pNEXT, from the entry in the current map 400, 450 is zero, then the end of the linked list has been reached. Thus, program control proceeds to step 1080, where a test is performed to determine if the number of balls away, NBA, from a winning pattern is zero (i.e., if there is a winner). It is noted that if a bingo game includes complimentary bingo cards, or bingo cards that are otherwise played purely for entertainment, and not for a winning payout, these complimentary bingo cards are excluded from the test performed during step 1080. If it is determined during step 1080 that the number of balls away, NBA, from a winning pattern is not zero, then program control returns to step 1010 to process the next ball drawn.

If, however, it is determined during step 1080 that the number of balls away, NBA, from a winning pattern is zero, then there is a winner. Thus, game play is suspended during step 1090 and the winner is validated and identified, before program control terminates during step 1095.

It is to be understood that the embodiments and variations shown and described herein are merely illustrative of the principles of this invention and that various modifications may be implemented by those skilled in the art without departing from the scope and spirit of the invention. For example, in European bingo, the numbers 1 through 90 are divided into five sets, with each set having eighteen possible numbers. Thus, five bits can be allocated to each square of the bingo card, allowing the values 0 through 17 to be represented. Likewise, the size of the pointers in the maps 400, 450 can be increased, if necessary, to support a larger number of cards.

I claim:

1. A method for automatically identifying and marking a bingo card in a bingo game that includes a plurality of bingo cards having a plurality of values, the method comprising:

creating and storing a map base that contains an entry for each possible value on a bingo card;

creating and storing a card map for each bingo card that is in play for a particular game, wherein each card map contains an entry for each square of a bingo card;

creating and storing a linked list for each possible value in a bingo game comprising a pointer to the next card map that contains the value associated with the linked list; and creating and storing a winning template map for each possible winning combination of squares.

2. The method of claim 1, wherein the linked list for each possible value begins with an entry on the map base.

3. The method of claim 2, wherein the entry on the map base contains a pointer to the first card map containing the value associated with the linked list and the particular square on the card where the value is located.

4. The method of claim 3, wherein the entry on each card map except the last card map in the linked list contains a pointer that indexes the next card map in the linked list.

5. The method of claim 4, wherein the entry on the last card map in the linked list indicates that the last card map in the linked list has been reached.

6. The method of claim 5, further comprising:

identifying a map base entry that corresponds to a drawn bingo number;

following the linked list from the map base entry to each of the card maps containing the drawn bingo number;

marking each card map in the linked list with an indicator;

comparing each card map after it has been marked to each winning template map to determine how many squares are necessary to win the game; and upon reaching the end of the linked list, waiting for the next ball to be drawn before repeating the four (4) steps above.

7. The method of claim 6, wherein the marking of each card map comprises changing a value from not set to set in electronic memory corresponding to a particular bingo card square.

8. The method of claim 6, further including:

verifying a winner and ending the game if, upon comparison, the card map matches the winning template map, wherein a card map matches a winning template map if the number of squares necessary to win the game is equal to zero.

9. The method of claim 6, further including:

storing the number of squares necessary to win the game for each card map in electronic memory.

10. The method of claim 1, wherein the winning template map and the card map square indicators are represented by an electronic bitmap containing either a set or not set value for each square of a bingo card.

11. The method of claim 1, wherein the map base, card maps, and winning templates are stored in electronic memory.

* * * * *